US008515768B2

(12) United States Patent
Baumgarte et al.

(10) Patent No.: US 8,515,768 B2
(45) Date of Patent: Aug. 20, 2013

(54) ENHANCED AUDIO DECODER

(75) Inventors: Frank Baumgarte, Sunnyvale, CA (US); William Stewart, Los Altos, CA (US); Shyh-Shiaw Kuo, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 1024 days.

(21) Appl. No.: 12/551,450

(22) Filed: Aug. 31, 2009

(65) Prior Publication Data

US 2011/0054911 A1 Mar. 3, 2011

(51) Int. Cl.
*G10L 19/00* (2006.01)

(52) U.S. Cl.
USPC ..... 704/500; 704/203; 704/205; 381/17; 381/22

(58) Field of Classification Search
USPC ..... 704/500, 203, 205; 381/17, 22
See application file for complete search history.

(56) References Cited

U.S. PATENT DOCUMENTS

| | | | | |
|---|---|---|---|---|
| 6,356,639 | B1 | 3/2002 | Ishito et al. | |
| 6,903,664 | B2 | 6/2005 | Schröder et al. | |
| 7,006,636 | B2 | 2/2006 | Baumgarte et al. | |
| 7,392,176 | B2 | 6/2008 | Nishio et al. | |
| 2004/0028244 | A1 * | 2/2004 | Tsushima et al. | 381/98 |
| 2005/0080621 | A1 | 4/2005 | Tsushima et al. | |
| 2007/0168197 | A1 | 7/2007 | Vasilache | |
| 2008/0077412 | A1 | 3/2008 | Oh et al. | |
| 2008/0082321 | A1 | 4/2008 | Ide | |
| 2008/0120096 | A1 | 5/2008 | Oh et al. | |
| 2009/0112579 | A1 | 4/2009 | Li et al. | |
| 2010/0153120 | A1 | 6/2010 | Shirakawa et al. | |
| 2010/0262427 | A1 | 10/2010 | Chivukula et al. | |
| 2011/0054885 | A1 * | 3/2011 | Nagel et al. | 704/203 |

FOREIGN PATENT DOCUMENTS

DE EP2146344 A1 1/2010

OTHER PUBLICATIONS

Dietz, Martin, et al. "Spectral Band Replication, a novel approach in audio coding." Audio Engineering Society Convention Paper 5553, May 2002.*

Arttu Laaksonen, "Bandwidth extension in high-quality audio coding" in Master's Thesis, Helsinki University of Technology, May 30, 2005.*

Kepesi, Marian, Authorized Officer, International Search Report and Written Opinion in Application No. PCT/US2010/047269, mailed Dec. 20, 2010, 14 pages.

(Continued)

*Primary Examiner* — Vincent P Harper

(74) *Attorney, Agent, or Firm* — Blakely, Sokoloff, Taylor & Zafman LLP

(57) ABSTRACT

Methods, systems, and apparatus are presented for decoding an audio signal that includes bandwidth extension data. An audio signal that includes core audio data and bandwidth extension data can be received in a decoder. The core audio data can be associated with a core portion of an audio signal, such as the frequency range below a cutoff frequency, and the bandwidth extension data can be associated with an extended portion of the audio signal, such as a frequency range above the cutoff frequency. The core audio data can be decoded to generate a decoded core audio signal in a time domain representation. Further, an extended portion of the audio signal can be reconstructed in accordance with extension data and decoded core audio signal. Additionally, the decoded core audio signal can be lowpass filtered and the extended portion can be highpass filtered before being combined to generate a decoded output signal.

26 Claims, 5 Drawing Sheets

(56) References Cited

OTHER PUBLICATIONS

Ekstrand, Per, "Bandwidth Extension of Audio Signals by Spectral Band Replication", Proc. 1st IEEE Benelux Workshop, Nov. 15, 2002, Leuven, Belgium, p. 53-58.

Hsu, Han-Wen et al., "High Quality, Low Power Qmf Bank Design for SBR, Parametric Coding, and MPEG Surround Decoders", AES Convention 122, May 1, 2007, AES, New York, USA, p. 1-10.

Spanias, Andreas et al., "Audio Signal Processing and Coding", 2007, John Wiley & Sons, New Jersey, USA, 2.8 Review of Multirate Signal Processing, p. 33-39.

Sylvester, Hannah, Examiner, GB Intellectual Property Office, Combined Search and Examination Report in Application No. GB1014415.2, mailed Dec. 14, 2010, 5 pages.

* cited by examiner

ENHANCED AUDIO DECODER

TECHNICAL FIELD

The present disclosure relates to decoding of audio data, such as audio data encoded using the High-Efficiency Advanced Audio Coding (HE-AAC) scheme, and to enhancements to the decoding of audio data.

BACKGROUND

Audio coding is used to represent the content of an audio signal with a reduced amount of data, e.g. bits, while retaining audio signal quality. An audio signal can be coded to reduce the amount of data that needs to be stored to reconstruct the audio signal, such as for playback. Further, a coded representation of an audio signal can be transmitted using a reduced amount of bandwidth. Thus, a coded audio signal can be transmitted, e.g. over a network, more quickly or over a lower bandwidth connection than an uncoded audio signal.

An audio codec (coder-decoder) can perform audio compression to reduce the size of an audio file. A codec can employ a lossless strategy, in which all of the audio signal data is retained in the coded signal, or a lossy strategy, in which some of the original audio signal data cannot be retrieved from the coded audio signal. High-efficiency advanced audio coding (HE-AAC) is a lossy audio coding scheme that has been adopted by the Moving Picture Experts Group (MPEG) for use in audio compression and transmission, including streaming audio.

Bandwidth extension strategies also have been developed for use in coding audio signals. For example, Spectral Bandwidth Replication (SBR) is a bandwidth extension strategy that has been adopted for use with HE-AAC coding and decoding. SBR data is added by an encoder to an audio data stream and can be parsed from the audio data stream by a receiving decoder for use in decoding. For instance, in HE-AAC coding, the low frequency portion (or "core signal") of an audio signal is coded up to a cut-off frequency. SBR data representing the high frequency portion of the audio signal, i.e. all frequencies above the cut-off, is determined at the encoder from the available high frequency portion of the audio signal. The SBR data is generated such that the high frequency portion of the audio signal can be reconstructed at the decoder based on the low frequency portion. Further, the SBR data is generated so that the high frequency portion of the audio signal can be reconstructed to be perceptually as similar as possible to the original high frequency portion. The low frequency portion and the reconstructed high frequency portion of the audio signal further can be merged to produce a decoded audio signal.

Bandwidth extension strategies rely on filter banks to transform audio signals between the time and frequency domains. For instance, SBR uses a Quadrature Mirror Filter (QMF) bank to transform a frequency domain representation of an audio signal into a time domain representation (and vice versa). The QMF bank is designed to operate without introducing aliasing distortion. However, because the QMF filter bank synthesizes the entire frequency range of the audio signal, some distortion nonetheless can be introduced into the low frequency portion of the signal.

SUMMARY

Distortion associated with a high frequency portion of an audio signal can be isolated during decoding. Thus, distortion associated with a high frequency portion of an audio signal is not introduced into a corresponding low frequency portion, i.e. the core signal, during decoding. Further, a process for decoding an audio signal encoded using a bandwidth extension strategy, e.g. SBR, can be implemented such that the decoded low frequency portion of the audio signal has no more distortion than when high frequency components are not present. The frequency range of an audio signal thus can be extended, e.g. beyond the normal operating range of the human ear, without degrading quality or significantly increasing the size or bandwidth required to transmit the audio signal.

The present inventors recognized a need to isolate distortion, e.g. QMF distortion, resulting during decoding to the high frequency SBR portion of an audio signal. The present inventors also recognized a need to reduce distortion by replacing coefficients associated with the HE-AAC decoder QMF synthesis filter bank and QMF analysis filter bank with coefficients that provide an improved frequency domain representation of the core AAC signal. Further, a need to permit selecting between low-power and high-power decoding options also was recognized.

The present inventors also recognized a need to bypass filter banks, e.g. QMF filter banks, during decoding of the low frequency portion of a bandwidth extended audio signal, such as an HE-AAC signal. The need to prevent transforming the low frequency portion of a signal into the frequency domain and back into the time domain during decoding also was recognized. Further, the present inventors recognized a need to separately filter the low frequency portion of an audio signal and the high frequency portion of an audio signal prior to combining them to reduce the introduction of distortion into the decoded audio signal. Accordingly, the techniques and apparatus described here implement algorithms for encoding high-quality audio signals using an encoding scheme that employs a bandwidth extension strategy, e.g. HE-AAC, without introducing additional distortion into the core audio signal.

In general, in one aspect, the techniques can be implemented to include receiving, in an audio decoder, core audio data associated with a core portion of an audio signal and extension data associated with an extended portion of the audio signal, decoding the core audio data to generate a decoded core audio signal in a time domain representation, generating a reconstructed extended portion of the audio signal in accordance with the extension data and the decoded core audio signal, filtering, using a highpass filter, the reconstructed extended portion of the audio signal to generate a reconstructed output signal, and combining the decoded core audio signal and the reconstructed output signal to generate a decoded output signal.

The techniques also can be implemented such that generating a reconstructed extended portion of the audio signal further includes transforming, using a filter bank, the reconstructed extended portion of the audio signal into a time domain representation. Further, the techniques can be implemented such that the filter bank is a complex Quadrature Mirror Filter bank. Additionally, the techniques can be implemented such that the extension data is spectral band replication data. Also, the techniques also can be implemented to include filtering, using a lowpass filter, the decoded core audio signal prior to the combining. The techniques further can be implemented to include configuring the highpass filter and the lowpass filter to have a combined spectral response that equals a flat frequency response.

In general, in another aspect, the techniques can be implemented as a computer program product, encoded on a computer-readable medium, operable to cause data processing apparatus to perform operations including receiving, in an audio decoder, core audio data associated with a core portion of an audio signal and extension data associated with an extended portion of the audio signal, decoding the core audio data to generate a decoded core audio signal in a time domain representation, generating a reconstructed extended portion of the audio signal in accordance with the extension data and the decoded core audio signal, filtering, using a highpass filter, the reconstructed extended portion of the audio signal to generate a reconstructed output signal, and combining the decoded core audio signal and the reconstructed output signal to generate a decoded output signal.

The techniques also can be implemented to be further operable to cause data processing apparatus to perform operations including transforming, using a filter bank, the reconstructed extended portion of the audio signal into a time domain representation. Additionally the techniques can be implemented to be further operable to cause data processing apparatus to perform operations including parsing a received bitstream to separate the core audio data and the extension data. Also, the techniques can be implemented to be further operable to cause data processing apparatus to perform operations including filtering, using a lowpass filter, the decoded core audio signal prior to the combining. Further, the techniques can be implemented to be further operable to cause data processing apparatus to perform operations including configuring the highpass filter and the lowpass filter to have a combined spectral response that equals a flat frequency response. Additionally, the techniques can be implemented to be further operable to cause data processing apparatus to perform operations including generating subband signals based on at least a portion of the decoded core audio signal and selecting, in accordance with the extension data, subband signals for use in generating the reconstructed extended portion.

In general, in another aspect, the subject matter can be implemented to include decoding low frequency audio data corresponding to an audio signal portion below a cutoff frequency to generate a decoded low frequency signal having a time domain representation, generating high frequency audio data from extension data and at least a portion of the decoded low frequency signal, transforming, using a filter bank, the high frequency audio data into a time domain representation to generate a decoded high frequency signal, filtering at least one of the decoded low frequency signal and the decoded high frequency signal to reduce a distortion, and combining the decoded low frequency signal and the decoded high frequency signal to generate a decoded output signal.

Further, the techniques can be implemented such that generating high frequency audio data further includes generating subband signals based on at least a portion of the decoded low frequency signal and selecting, in accordance with the extension data, subband signals for use in generating the high frequency audio data. The techniques also can be implemented to include canceling the generated subband signals prior to transforming the high frequency audio data. Additionally, the techniques can be implemented such that filtering further includes filtering the decoded low frequency signal using a lowpass filter that matches a response of the filter bank.

The techniques also can be implemented such that the filter bank comprises a Quadrature Mirror Filter bank. Further, the techniques can be implemented such that filtering further includes filtering the decoded low frequency signal using a lowpass filter and the decoded high frequency signal using a highpass filter, wherein the lowpass filter and the highpass filter overlap for a portion of a frequency range of the audio signal.

In general, in another aspect, the techniques can be implemented as a computer program product, encoded on a computer-readable medium, operable to cause data processing apparatus to perform operations including decoding low frequency audio data corresponding to an audio signal portion below a cutoff frequency to generate a decoded low frequency signal having a time domain representation, generating high frequency audio data from extension data and at least a portion of the decoded low frequency signal, transforming, using a filter bank, the high frequency audio data into a time domain representation to generate a decoded high frequency signal, filtering at least one of the decoded low frequency signal and the decoded high frequency signal to reduce a distortion, and combining the decoded low frequency signal and the decoded high frequency signal to generate a decoded output signal.

The techniques also can be implemented to be further operable to cause data processing apparatus to perform operations including generating subband signals based on at least a portion of the decoded low frequency signal and selecting, in accordance with the extension data, subband signals for use in generating the high frequency audio data. Further, the techniques can be implemented to be further operable to cause data processing apparatus to perform operations including canceling the generated subband signals prior to transforming the high frequency audio data. Additionally, the techniques can be implemented to be further operable to cause data processing apparatus to perform operations including parsing a received bitstream to separate the low frequency audio data and the extension data.

The techniques also can be implemented to be further operable to cause data processing apparatus to perform operations including filtering the decoded low frequency signal using a lowpass filter and the decoded high frequency signal using a highpass filter, wherein the lowpass filter and the highpass filter overlap for a portion of a frequency range of the audio signal.

In general, in another aspect, the subject matter can be implemented as a system including an input configured to receive an audio bitstream and an audio decoder including processor electronics configured to perform operations including decoding low frequency audio data associated with the audio bitstream to generate a decoded low frequency signal, the low frequency audio data corresponding to an audio signal portion below a cutoff frequency, generating high frequency audio data from extension data associated with the audio bitstream and at least a portion of the decoded low frequency signal, transforming, using a filter bank, the high frequency audio data into a time domain representation to generate a decoded high frequency signal, filtering at least one of the decoded low frequency signal and the decoded high frequency signal to reduce a distortion, and combining the decoded low frequency signal and the decoded high frequency signal to generate a decoded output signal.

The techniques also can be implemented such that the audio decoder further includes a highpass filter and a lowpass filter configured to have a combined spectral response that equals a flat frequency response. Further, the techniques can be implemented such that the highpass filter and the lowpass filter overlap for a portion of a frequency range. Additionally, the techniques can be implemented such that the audio decoder further includes a delay element configured to delay the decoded low frequency signal. Further, the techniques can be implemented such that a delay duration associated with the delay element corresponds to a processing delay of the filter bank. Also, the techniques can be implemented such that the audio decoder further includes an analysis filter bank configured to generate subband signals based on at least a portion of the decoded low frequency signal and a canceller configured to zero-out the generated subband signals. Additionally, the techniques can be implemented such that the filter bank comprises a Quadrature Mirror Filter bank.

The techniques described in this specification can be implemented to realize one or more of the following advantages. For example, the techniques can be implemented such that an audio coding scheme employing bandwidth extension can be used to encode a high-quality audio signal, e.g. having an audio spectrum that extends beyond the normal operating range of the human ear. Further, the techniques can be implemented such that distortion associated with an extended portion of the signal is not introduced into a core portion of the signal. The techniques also can be implemented to provide a decoded HE-AAC signal in which the quality of the core AAC signal is uncompromised relative to a corresponding AAC signal.

Further, the techniques can be implemented to permit bypassing one or more filter banks for at least a portion of the decoding path. Thus, conversion to a frequency domain representation and back to a time domain representation can be avoided for at least a portion of the decoded signal. The techniques also can be implemented to permit using complimentary low pass and high pass filters to eliminate distortion from corresponding portions of a decoded audio signal. Additionally, the techniques can be implemented to permit selecting between decoding options based on a bypass implementation and a modified filter coefficient implementation in response to one or more factors, such as computing resources and battery power.

The details of one or more implementations are set forth in the accompanying drawings and the description below. Other features and advantages will be apparent from the description and drawings, and from the claims.

BRIEF DESCRIPTION OF THE DRAWINGS

Like reference symbols indicate like elements throughout the specification and drawings.

DETAILED DESCRIPTION

Figure 1:
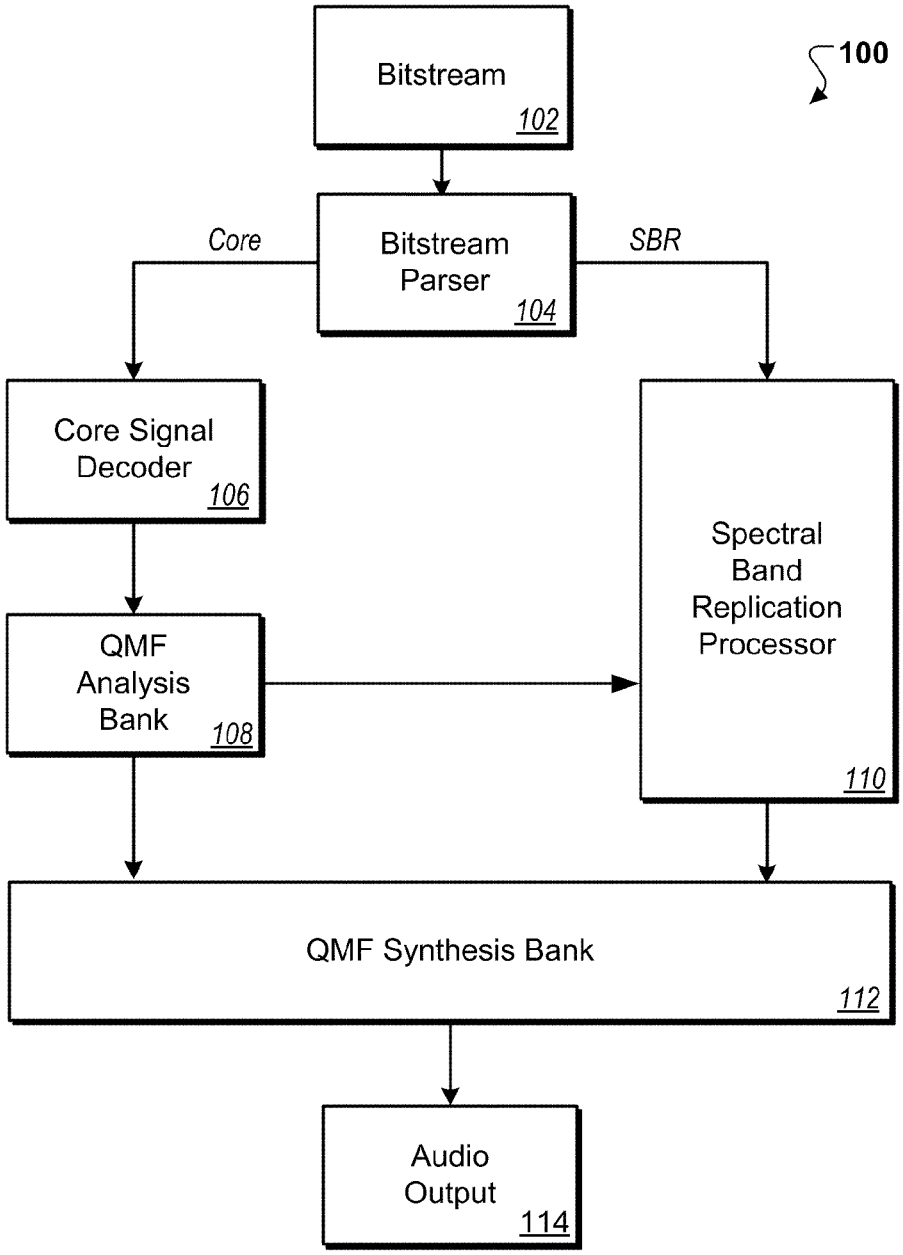
FIG. 1 shows a modified audio decoder configured to decode a bandwidth extended audio signal.

A codec configured to implement a bandwidth extension scheme can be adapted for use with high-quality audio signals instead of or in addition to low bit-rate audio signals. For instance, a portion of a high-quality, high bit-rate audio signal, e.g. a high frequency portion, can be encoded using SBR data. Further, the decoder can be implemented to prevent distortion associated with processing the portion encoded using SBR data from being introduced to a remaining portion of the signal, e.g. a low frequency portion. FIG. 1 shows a modified audio decoder configured to decode a bandwidth extended audio signal. Modified audio decoder 100 can receive an audio bitstream 102 corresponding to an audio signal encoded using a bandwidth extension scheme, such as an HE-AAC bitstream. Audio bitstream 102 can include core data associated with a core portion of the audio bitstream. For instance, the core data can represent a low frequency (or lowband) portion of an original audio signal, which can be defined with respect to a cutoff frequency. The bandwidth of the low frequency portion, and thus the cutoff frequency, can be selected based on a target bit rate. Data identifying the cutoff frequency can be encoded in audio bitstream 102. Further, audio bitstream 102 can include bandwidth extension data, e.g. SBR data, defining a portion of the original audio signal above the cutoff frequency. The core data and bandwidth extension data can be arranged in audio bitstream 102 in any manner, including through multiplexing.

The received audio bitstream 102 can be passed to bitstream parser 104, which can separate, e.g. demultiplex, the bitstream data. For instance, bitstream parser 104 can divide (or extract) the core data from audio bitstream 102 and generate a core data stream. The core data stream can be provided to a core signal decoder 106 for decoding. Further, bitstream parser 104 can divide the bandwidth extension data from audio bitstream 102 and generate a spectral band replication (SBR) data stream. The SBR data stream can be provided to SBR processor 110 for decoding and post-processing operations. In some implementations, other bandwidth extension schemes can be chosen and a data stream corresponding to the chose extension scheme can be generated in place of the SBR data stream. Further, in such implementations, SBR processor 110 can be replaced with a processor adapted to the chosen extension scheme.

Core signal decoder 106 decodes the core data to generate a time domain representation of the decoded core audio signal. The decoded core audio signal can correspond to a low frequency portion of the original audio signal, e.g. frequencies between 0 and 22 kHz. For instance, where audio bitstream 102 is an HE-AAC bitstream, the decoded core audio signal can correspond to the decoded AAC signal.

Further, the decoded core audio signal can be provided to a modified QMF analysis bank 108, which can transform the decoded core audio signal into a frequency domain representation. QMF analysis bank 108 can employ a modified QMF bank (discussed below) to analyze the decoded core audio signal and to generate subband signals, e.g. corresponding to 32 subbands, for use in reconstructing the high frequency portion of the original audio signal. In some implementations, the decoded core audio signal can be upsampled prior to generating the subband signals. The subband signals generated by QMF analysis bank 108 can be provided to SBR processor 110 and to QMF synthesis bank 112. In some implementations, QMF analysis bank 108 can be configured to switch between the modified QMF bank and a conventional QMF bank, such as a QMF bank associated with a standard HE-AAC decoder. For example, QMF analysis bank 108 can be configured to switch from the modified QMF bank in response to detecting a low power state or limited resources.

SBR processor 110 reconstructs the high frequency portion of the original audio signal using the SBR data stream and the low frequency subband signals received from QMF analysis bank 108. SBR processor 110 can be configured to select, based on SBR data, one or more of the low frequency subband signals for use in generating high frequency subband signals. Further, SBR processor 110 can be configured to adjust the envelope of the generated high frequency subband signals to generate the reconstructed high frequency portion of the audio signal.

The low frequency subband signals generated by QMF analysis bank 108 and the reconstructed high frequency portion of the audio signal generated by SBR processor 110 are provided to a modified QMF synthesis bank 112. In order to ensure the proper timing, the low frequency subband signals output by QMF analysis bank 108 can be delayed to coincide with output of the high frequency signals from SBR processor 110. QMF synthesis bank 112 combines the low frequency portion, represented by the low frequency subband signals, and the reconstructed high frequency portion to generate a decoded audio signal.

QMF synthesis bank 112 can be configured to use a modified QMF bank designed to reduce or eliminate distortion in the decoded audio signal that was not present at the output of core signal decoder 106. QMF analysis bank 108 also can be configured to use the modified QMF bank or an adaptation thereof. As with QMF analysis bank 108, QMF synthesis bank 112 also can be configured to switch between the modified QMF bank and a conventional QMF bank, such as a QMF bank associated with a standard HE-AAC decoder. Further, a filter bank switch can be coordinated, such that QMF analysis bank 108 and QMF synthesis bank 112 are configured to use corresponding filter banks.

Figure 2:
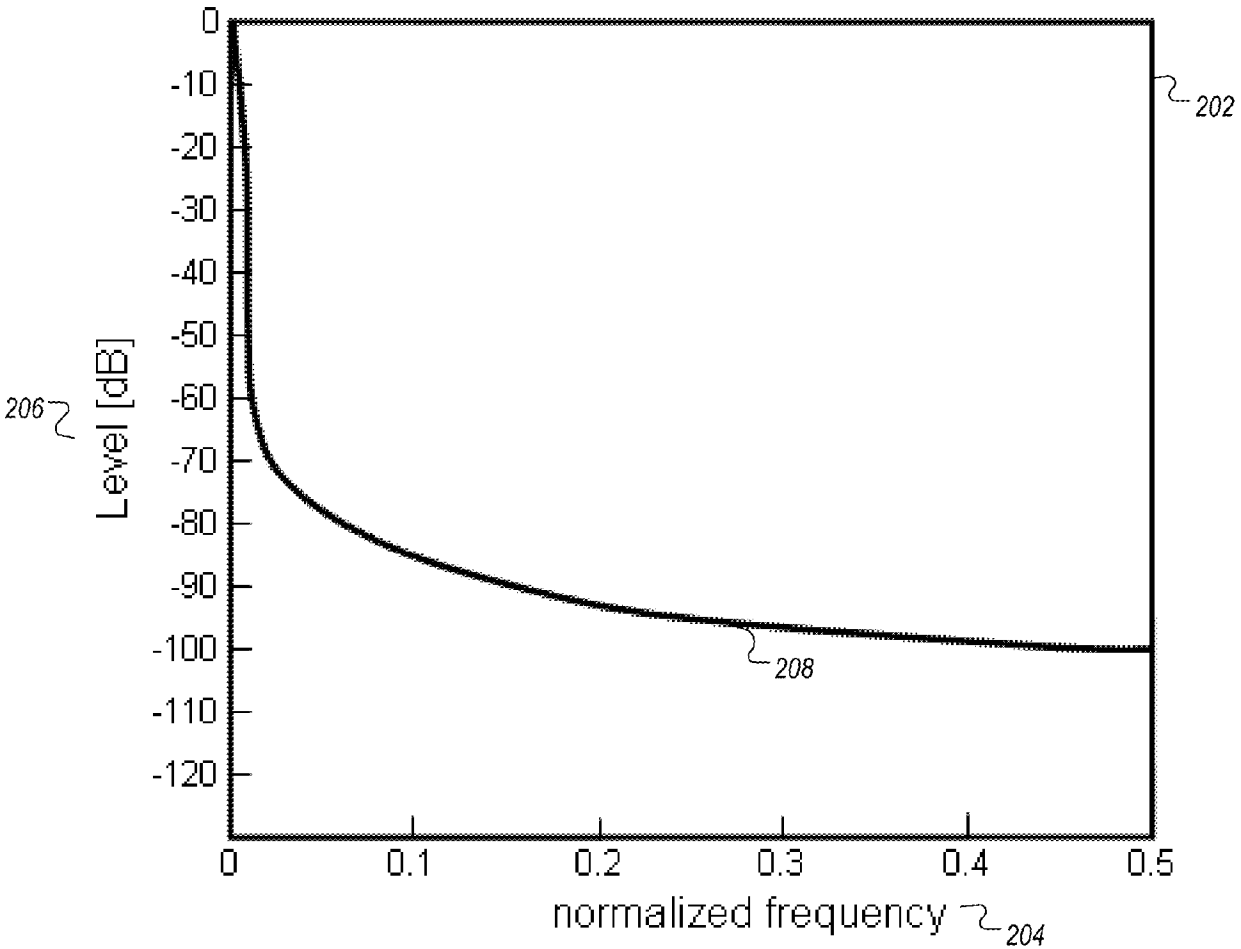
FIG. 2 depicts the target frequency response for a prototype lowpass filter of an exemplary modified QMF bank.

A prototype lowpass filter of the modified QMF bank can have a passband centered at a selected frequency, e.g. 0 kHz, and a stopband representing a range of frequencies to be attenuated, e.g. 500 Hz to 48 kHz. In some implementations, the starting frequency of the stopband can be determined during filter optimization. The remaining filters in the filter bank can be derived based on the prototype lowpass filter, such that the bandpass filters corresponding to each of the subbands have characteristics, e.g. a frequency response, similar to the lowpass filter. For example, a modified QMF bank can be configured to use 64 subband filters, wherein each filter has a similar frequency response to the lowpass filter but is shifted with respect to the frequency range that can be passed. Further, the modified QMF bank can be adapted to attenuate the frequencies in the stopband by a predetermined amount, e.g. approximately 70-90 decibels (dB). An exemplary implementation of the modified QMF bank is discussed with respect to FIG. 2. However various implementations are possible. The modified QMF bank can include a greater number of, and thus more accurate, filter coefficients. Further, because the length of the modified QMF bank is increased, filter design optimization can be performed to maintain the filter properties required by the QMF structure while achieving the target frequency response, e.g. as illustrated in FIG. 2. In some implementations, QMF analysis bank 108 and QMF synthesis bank 112 can be replaced by a complex filter bank not of the QMF type, where the complex filter bank nonetheless achieves the target frequency response.

QMF synthesis bank 112 can provide the decoded audio signal to audio output 114 in a time domain representation, e.g. in a pulse code modulation (PCM) format. Further, audio output 114 can output the decoded audio signal, e.g. to an application or audio output.

FIG. 2 depicts the target frequency response for a prototype lowpass filter of an exemplary modified QMF bank. The x-axis of graph 202 indicates the normalized frequency 204 of the lowpass filter and the y-axis indicates the level of attenuation 206, measured in dB. The passband of the prototype lowpass filter is centered at frequency 0. Further, plot 208 shows that the stopband attenuation is generally 90 dB or greater. Distortion generated at this level of attenuation likely cannot be detected by the human ear. The remaining subband filters included in the modified QMF bank each can be shifted, with respect to frequency, relative to the lowpass filter to correspond to a particular one of the included subbands, e.g. 32 or 64. Further, each of the remaining subband filters in the modified QMF bank can be configured to have a frequency response similar to that of the prototype lowpass filter. The modified QMF bank can be configured using any coefficients that approximate the target frequency response.

Figure 3:
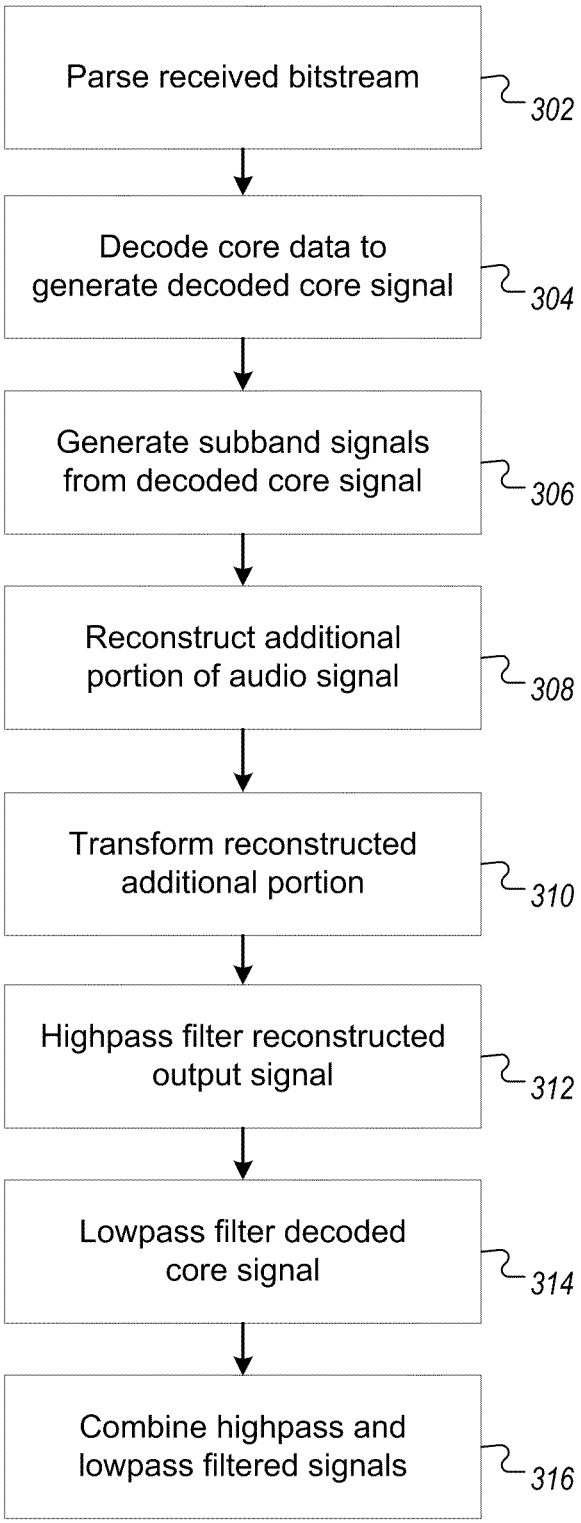
FIG. 3 shows a flow diagram describing an exemplary process for decoding a bandwidth extended audio signal.

FIG. 3 shows a flow diagram describing an exemplary process for decoding a bandwidth extended audio signal. The bandwidth extended audio signal can be represented in a bitstream that includes core data associated with a core portion of the coded audio signal, e.g. a low frequency portion, and bandwidth extension data, e.g. SBR data, associated with an extended portion of the coded audio signal. The bitstream can be received in a decoder and parsed to separate the core data from the bandwidth extension data (302).

The core data can be decoded to generate a decoded core signal (304). The core data can be decoded using a core decoder, which can produce a time domain representation of the core portion of the coded audio signal. For instance, the bandwidth extended audio signal can be an HE-AAC bitstream and the core data can be decoded using an AAC core decoder. Further, the decoded core signal can be processed, e.g. using a QMF analysis bank, to generate corresponding subband signals (306). For instance, a copy of the time domain representation of the decoded core signal can be transformed into a frequency domain representation using the QMF analysis bank. The frequency domain representation further can be divided into a number, e.g. 32, of subband signals. Another copy of the time domain representation of the decoded core signal can be routed to storage or to a delay element.

Further, the subband signals and the bandwidth extension data, e.g. SBR data, can be used to generate a reconstructed portion of the coded audio signal (308). The reconstructed portion can correspond to a frequency range above that of the core signal. The bandwidth extension data can be used to select one or more of the subband signals corresponding to the decoded core signal for use in reconstructing subband signals corresponding to the extended portion of the coded audio signal. The reconstructed extended portion of the coded audio signal also can be transformed from the frequency domain into the time domain (310). For instance, a QMF synthesis filter bank can receive the reconstructed subband signals and can transform them into a time domain representation of the reconstructed output signal.

Additionally, the time domain representation of the reconstructed output signal, e.g. corresponding to a high frequency portion of the coded audio signal, can be highpass filtered to produce a highpass filtered output signal (312). The highpass filter can be configured to pass only the reconstructed output signal and thus to attenuate any signals, including distortion, having a frequency below the passband. Distortion in the frequency range of the decoded core signal, e.g. generated by the QMF synthesis filter bank and/or high frequency processing, thus can be removed from the reconstructed output signal.

Also, the decoded core signal can be lowpass filtered to generate a lowpass filtered output signal (314). For instance, the decoded core signal can be retrieved from storage or provided by the delay element when the corresponding reconstructed output signal is highpass filtered. Lowpass filtering can be performed such that substantially only the frequency range of the decoded core signal is passed and other frequencies are filtered, including the frequency range of the reconstructed output signal. The highpass filter and lowpass filter can be complementary, such that their combined spectral response equals a flat frequency response. Further, the lowpass filtered output signal and the highpass filtered output signal can be combined to generate a decoded audio signal (316).

Figure 4:
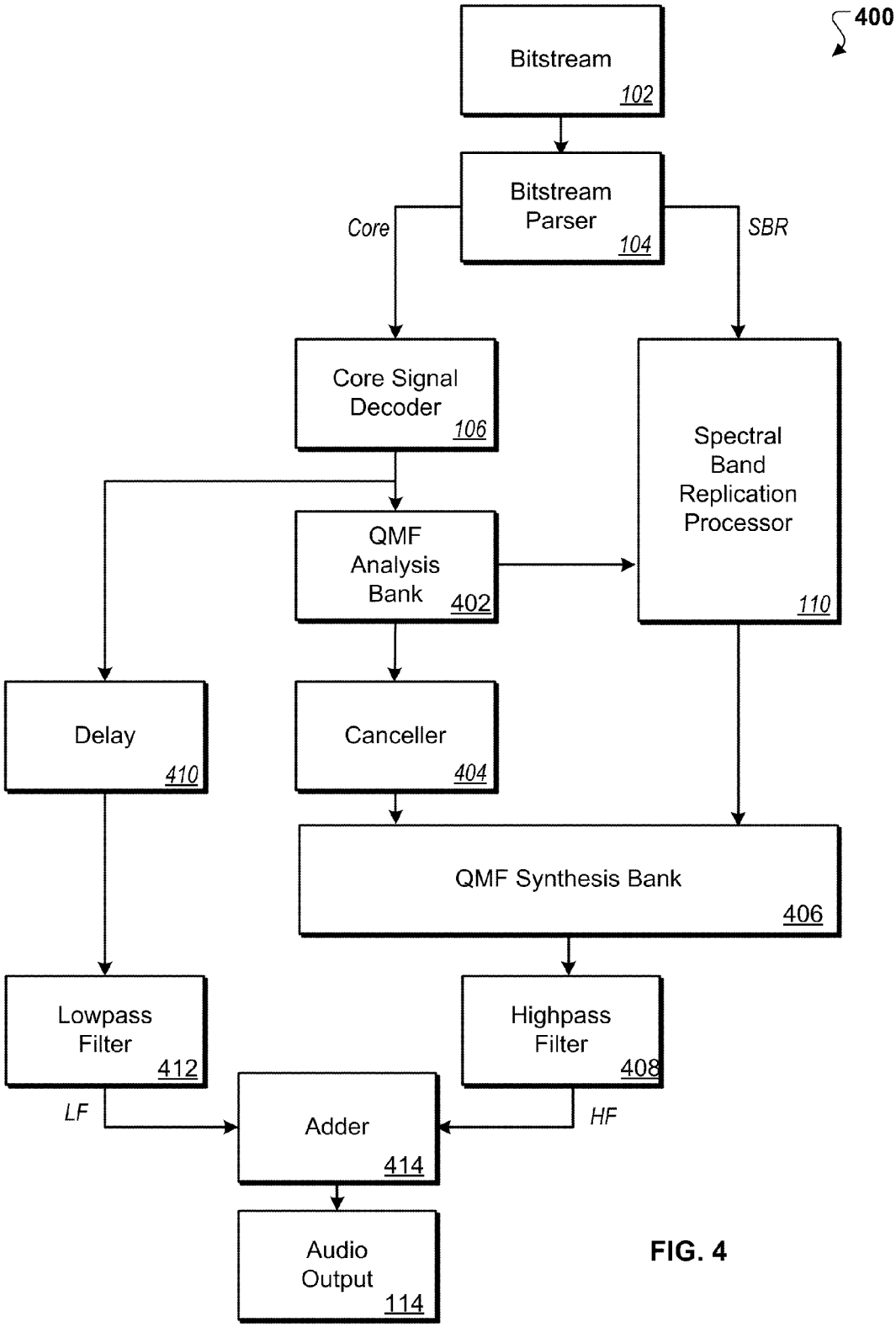
FIG. 4 shows a modified audio decoder, including a bypass, that is configured to decode a bandwidth extended audio signal.

A decoder can be implemented such that a portion, e.g. the core signal, of the decoded signal bypasses the QMF filter banks. The portion of the signal routed through the bypass thus remains unaffected by distortion associated with processing in the QMF filter banks. The decoder can be implemented in software, hardware, firmware, or any combination thereof. In some implementations, the decoder can be configured to route a portion of the signal through the bypass as an alternative to using a modified filter bank in response to one or more factors, such as detecting a low power state or limited resources. Further, the bypass can be selectively enabled/disabled in response to one or more factors, such as detecting a low power state or limited resources. FIG. 4 shows a modified audio decoder, including a bypass, that is configured to decode a bandwidth extended audio signal. Modified audio decoder 400 can receive an audio bitstream 102 corresponding to an audio signal encoded using a bandwidth extension scheme, such as an HE-AAC bitstream. The audio bitstream 102 can include core data associated with a core portion of the audio bitstream. For instance, the core data can represent a low frequency portion of an original audio signal, which can be defined with respect to a cutoff frequency. The bandwidth of the low frequency portion, and thus the cutoff frequency, can be selected based on a target bit rate. Data identifying the cutoff frequency can be encoded in audio bitstream 102. Further, audio bitstream 102 can include bandwidth extension data, e.g. SBR data, defining a portion of the original audio signal above the cutoff frequency. The core data and bandwidth extension data can be arranged in the audio bitstream in any manner, including through multiplexing.

Audio bitstream 102 can be passed to bitstream parser 104, which can separate, e.g. demultiplex, the bitstream data. For instance, bitstream parser 104 can divide the core data from audio bitstream 102 and generate a core data stream, which can be provided to core signal decoder 106 for decoding. Further, bitstream parser 104 can divide the bandwidth extension data from audio bitstream 102 and generate an SBR data stream. The SBR data stream can be provided to a spectral band replication (SBR) processor 110 for decoding and post-processing operations. In some implementations, other bandwidth extension schemes can be chosen and a data stream corresponding to the chose extension scheme can be generated in place of the SBR data stream. Further, in such implementations, SBR processor 110 can be replaced with a processor adapted to the chosen extension scheme.

Core signal decoder 106 decodes the core data to generate a time domain representation of the decoded core audio signal. The decoded core audio signal can correspond to a low frequency portion of the original audio signal, e.g. frequencies between 0 and 22 kHz. For instance, where audio bitstream 102 is an HE-AAC bitstream, the decoded core audio signal can correspond to the decoded AAC signal.

The decoded core audio signal is provided to delay element 410. The duration of the delay introduced by delay element 410 can be fixed and can be set to equal or approximate the timing of QMF analysis bank 402, canceller 404, and QMF synthesis bank 406. Thus, the decoded core audio signal can be provided to lowpass filter 412 at the same time or approximately the same time as the corresponding high frequency portion of the decoded audio signal is provided to highpass filter 408. The delay is expected to be consistent for a particular filter implementation, e.g. the QMF analysis bank 402 and QMF synthesis bank 406, and can be modified if the filter implementation is modified.

The decoded core audio signal also can be provided to QMF analysis bank 402, which can be configured in accordance with the HE-AAC standard. The QMF bank implemented by QMF analysis bank 402 can be either the complex QMF bank (standard) or the real QMF bank (low-power). QMF analysis bank 402 can be configured to transform the decoded core audio signal into a frequency domain representation and to analyze the decoded core audio signal and to generate subband signals, e.g. corresponding to 32 subbands, for use in reconstructing the high frequency portion of the original audio signal. In some implementations, the decoded core audio signal can be upsampled prior to generating the subband signals. The subband signals generated by QMF analysis bank 402 can be provided to SBR processor 110 and to canceller 404.

Canceller 404 is configured to zero-out (cancel) the subband signals received from QMF analysis bank 402. By zeroing-out the subband signals, canceller 404 also suppresses any distortion, such as high frequency processing artifacts, introduced into the decoded core audio signal during the conversion into the frequency domain and division into the subband signals.

SBR processor 110 reconstructs the high frequency portion of the original audio signal using the SBR data stream and the low frequency subband signals received from QMF analysis bank 402. SBR processor 110 can be configured to select, based on SBR data, one or more of the low frequency subband signals for use in generating high frequency subband signals. Further, SBR processor 110 can be configured to adjust the envelope of the generated high frequency subband signals to generate the reconstructed high frequency portion of the audio signal.

QMF synthesis bank 406 also can be configured in accordance with the HE-AAC standard, e.g. using the same filter bank as QMF analysis bank 402. As a result of the cancellation performed by canceller 404, only the reconstructed high frequency portion of the audio signal generated by SBR processor 110 is provided to QMF synthesis bank 406. QMF synthesis bank 406 transforms the received high frequency portion into a time domain signal, which is provided to highpass filter 408.

Highpass filter 408 and lowpass filter 412 are complementary, such that their combined spectral response equals a flat frequency response. Highpass filter 408 can be configured to pass only the reconstructed high frequency portion of the audio signal. As a result, distortion generated by processing in SBR processor 110 that is associated with frequencies below the cutoff can be eliminated. Thus, highpass filter 408 provides only the reconstructed high frequency portion of the audio signal to adder 414. In some implementations, canceller 404 can be removed and highpass filter 408 can be configured to attenuate all or substantially all of the signal below the cutoff frequency.

Further, lowpass filter 412 can be configured to pass the low frequency decoded core audio signal and to attenuate signals with a frequencies above the cutoff frequency. Thus, lowpass filter 412 provides only the low frequency decoded core audio signal to adder 414. In some implementations, highpass filter 408 can be omitted and lowpass filter 412 can be configured to match the filter bank response of QMF synthesis bank 406.

Adder 414 performs a time domain summation of the output of highpass filter 408 and lowpass filter 412 to generate the decoded audio signal. The decoded audio signal can then be provided to audio output 114.

Figure 5:
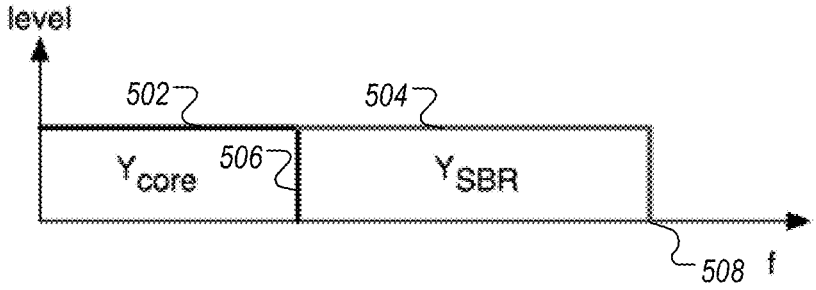
FIG. 5 shows an exemplary distortion level associated with a white noise signal for the output of a core decoder and a QMF synthesis filter bank.

FIG. 5 shows an exemplary distortion level associated with a white noise signal for the output of a core decoder and a QMF synthesis filter bank. The level of QMF distortion introduced into a constant signal, e.g. white noise, is illustrated for the core decoder by decoded low frequency portion 502, $Y_{core}$. Further, the level of QMF distortion is illustrated for the QMF synthesis filter bank by decoded high frequency portion 504, $Y_{SBR}$. In the ideal case, the decoded low frequency portion 502 and the decoded high frequency portion 504 are separated at a cutoff frequency 506, which can be indicated in the corresponding audio bitstream. The QMF distortion level is constant for the entire frequency range of the signal up to the highest frequency 508. Typically, the distortion level can vary with frequency and with audio signal level.

Figure 6:
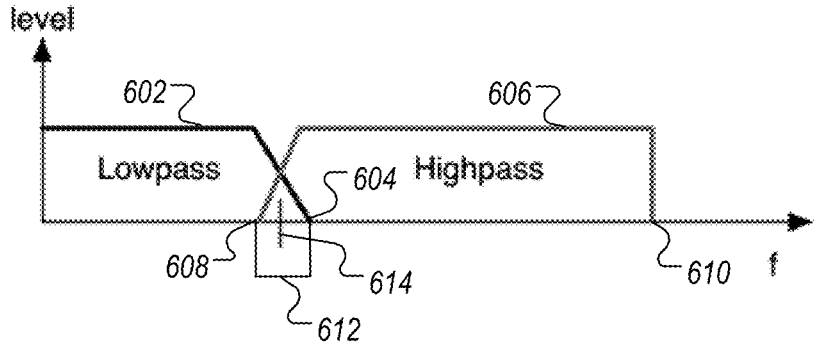
FIG. 6 shows an example of lowpass filtering the decoded low frequency portion and highpass filtering the decoded high frequency portion of the white noise signal.

FIG. 6 shows an example of lowpass filtering the decoded low frequency portion and highpass filtering the decoded high frequency portion of the white noise signal. The modified audio decoder that decodes the white noise signal can implement the lowpass and highpass filtering strategy discussed with respect to FIG. 4. A lowpass filter can be configured to have a lowpass band 602 that extends from a lowest frequency, e.g. 0 Hz, to an upper frequency 604. Thus, the lowpass band 602 corresponds generally to the decoded low frequency portion 502 of the signal. The lowpass filter can attenuate any signals having frequencies higher than upper frequency 604. Further, a highpass filter can be configured to have a highpass band 606 that extends from a lowest frequency 608 to a highest frequency 610 of the signal. Thus, the highpass band 606 corresponds generally to the decoded high frequency portion 504 of the signal. The highpass filter can attenuate any signals having frequencies lower than lowest frequency 608.

Further, the lowpass filter and the highpass filter can be coincident with respect to a crossover frequency range 612. Within crossover frequency range 612 the total contribution of the lowpass filter and the highpass filter must equal 1. Further, crossover frequency range 612 can be centered on a crossover point, such that both the lowpass filter and the highpass filter each have a contribution of 0.5 at the crossover point. The crossover point can be selected such that it corresponds to a frequency below the cutoff frequency.

Figure 7:
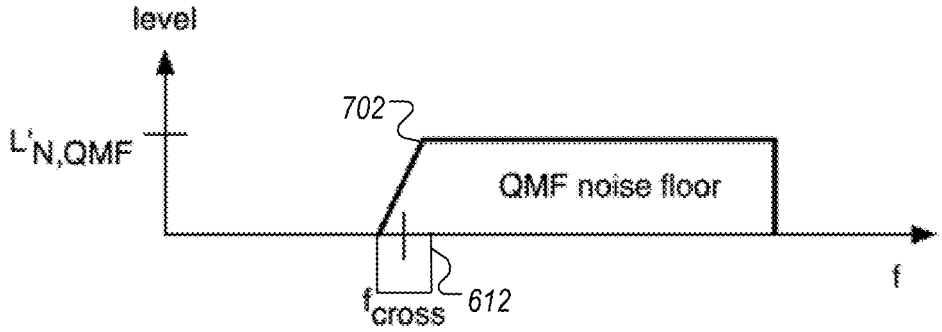
FIG. 7 shows an exemplary distortion level after lowpass and highpass filtering of the white noise signal.

FIG. 7 shows an exemplary distortion level after lowpass and highpass filtering of the white noise signal. The QMF distortion level 702 remaining after performing lowpass and highpass filtering is coextensive with the highpass band 606. Thus, the distortion introduced by QMF processing has energy only for the frequencies within the highpass band 606. Further, with the exception of crossover frequency range 612, the portion of the signal corresponding to the lowpass band 602 is free of QMF distortion.

The techniques and functional operations described in this disclosure can be implemented in digital electronic circuitry, or in computer software, firmware, or hardware, including the structural means described in this disclosure and structural equivalents thereof, or in combinations of them. The techniques can be implemented using one or more computer program products, e.g., machine-readable instructions tangibly stored on computer-readable media, for execution by, or to control the operation of one or more programmable processors or computers. Further, programmable processors and computers can be included in or packaged as mobile devices.

The processes and logic flows described in this disclosure can be performed by one or more programmable processors executing one or more instructions to receive, manipulate, and/or output data. The processes and logic flows also can be performed by programmable logic circuitry, including one or more FPGAs (field programmable gate array), PLDs (programmable logic devices), and/or ASICs (application-specific integrated circuit). General and/or special purpose processors, including processors of any kind of digital computer, can be used to execute computer programs and other programmed instructions stored in computer-readable media, including nonvolatile memory, such as read-only memory, volatile memory, such as random access memory, or both. Additionally, data and computer programs can be received from and transferred to one or more mass storage devices, including hard drives, flash drives, and optical storage devices. Further, general and special purpose computing devices and storage devices can be interconnected through communications networks. The communications networks can include wired and wireless infrastructure. The communications networks further can be public, private, or a combination thereof.

A number of implementations have been disclosed herein. Nevertheless, it will be understood that various modifications may be made without departing from the spirit and scope of the claims. Accordingly, other implementations are within the scope of the following claims.

What is claimed is:

1. A method of decoding an audio signal, the method comprising:

receiving, in an audio decoder, core audio data associated with a core portion of an audio signal and extension data associated with an extended portion of the audio signal;

decoding the core audio data to generate a decoded core audio signal in a time domain representation;

generating a reconstructed extended portion of the audio signal in accordance with the extension data and the decoded core audio signal in the frequency domain;

filtering, using a highpass filter, the reconstructed extended portion of the audio signal to generate a reconstructed output signal;

transforming, using a filter bank, the reconstructed extended portion of the audio signal into a time domain representation; and combining the decoded core audio signal and the reconstructed output signal to generate a decoded output signal after the reconstructed extended portion of the audio signal is transformed into a time domain representation.

2. The method of claim 1, wherein the filter bank comprises a complex Quadrature Mirror Filter bank.

3. The method of claim 1, wherein the extension data comprises spectral band replication data.

4. The method of claim 1, further comprising:

filtering, using a lowpass filter, the decoded core audio signal prior to the combining.

5. The method of claim 4, further comprising:

configuring the highpass filter and the lowpass filter to have a combined spectral response that equals a flat frequency response.

6. A computer program product, encoded on a non-transitory computer-readable medium, operable to cause data processing apparatus to perform operations comprising:

receiving, in an audio decoder, core audio data associated with a core portion of an audio signal and extension data associated with an extended portion of the audio signal;

decoding the core audio data to generate a decoded core audio signal in a time domain representation;

generating a reconstructed extended portion of the audio signal in accordance with the extension data and the decoded core audio signal;

filtering, using a highpass filter, the reconstructed extended portion of the audio signal to generate a reconstructed output signal;

transforming, using a filter bank, the reconstructed extended portion of the audio signal into a time domain representation; and combining the decoded core audio signal and the reconstructed output signal to generate a decoded output signal after the reconstructed extended portion of the audio signal is transformed into a time domain representation.

7. The computer program product of claim 6, further operable to cause data processing apparatus to perform operations comprising:

filtering, using a lowpass filter, the decoded core audio signal prior to the combining.

8. The computer program product of claim 7, further operable to cause data processing apparatus to perform operations comprising:

configuring the highpass filter and the lowpass filter to have a combined spectral response that equals a flat frequency response.

9. The computer program product of claim 6, further operable to cause data processing apparatus to perform operations comprising:

generating subband signals based on at least a portion of the decoded core audio signal; and selecting, in accordance with the extension data, subband signals for use in generating the reconstructed extended portion.

10. A method of decoding an audio signal, the method comprising:

decoding low frequency audio data corresponding to an audio signal portion below a cutoff frequency to generate a decoded low frequency signal having a time domain representation;

generating high frequency audio data from extension data and at least a portion of the decoded low frequency signal;

transforming, using a filter bank, the high frequency audio data into a time domain representation to generate a decoded high frequency signal;

filtering at least one of the decoded low frequency signal and the decoded high frequency signal to reduce a distortion; and combining the decoded low frequency signal and the decoded high frequency signal to generate a decoded output signal.

11. The method of claim 10, wherein generating high frequency audio data further comprises:

generating subband signals based on at least a portion of the decoded low frequency signal; and selecting, in accordance with the extension data, subband signals for use in generating the high frequency audio data.

12. The method of claim 11, further comprising:

canceling the generated subband signals prior to transforming the high frequency audio data.

13. The method of claim 10, wherein filtering further comprises:

filtering the decoded low frequency signal using a lowpass filter that matches a response of the filter bank.

14. The method of claim 13, wherein the filter bank comprises a Quadrature Mirror Filter bank.

15. The method of claim 10, wherein filtering further comprises:

filtering the decoded low frequency signal using a lowpass filter and the decoded high frequency signal using a highpass filter, wherein the lowpass filter and the highpass filter overlap for a portion of a frequency range of the audio signal.

16. A computer program product, encoded on a non-transitory computer-readable medium, operable to cause data processing apparatus to perform operations comprising:

decoding low frequency audio data corresponding to an audio signal portion below a cutoff frequency to generate a decoded low frequency signal having a time domain representation;

generating high frequency audio data from extension data and at least a portion of the decoded low frequency signal;

transforming, using a filter bank, the high frequency audio data into a time domain representation to generate a decoded high frequency signal;

filtering at least one of the decoded low frequency signal and the decoded high frequency signal to reduce a distortion; and combining the decoded low frequency signal and the decoded high frequency signal to generate a decoded output signal.

17. The computer program product of claim 16, further operable to cause data processing apparatus to perform operations comprising:

generating subband signals based on at least a portion of the decoded low frequency signal; and selecting, in accordance with the extension data, subband signals for use in generating the high frequency audio data.

18. The computer program product of claim 17, further operable to cause data processing apparatus to perform operations comprising:

canceling the generated subband signals prior to transforming the high frequency audio data.

19. The computer program product of claim 16, further operable to cause data processing apparatus to perform operations comprising:

filtering the decoded low frequency signal using a lowpass filter and the decoded high frequency signal using a highpass filter, wherein the lowpass filter and the highpass filter overlap for a portion of a frequency range of the audio signal.

20. A system comprising:

an input configured to receive an audio bitstream; and an audio decoder including processor electronics configured to perform operations comprising:

decoding low frequency audio data associated with the audio bitstream to generate a decoded low frequency signal, the low frequency audio data corresponding to an audio signal portion below a cutoff frequency;

generating high frequency audio data from extension data associated with the audio bitstream and at least a portion of the decoded low frequency signal;

transforming, using a filter bank, the high frequency audio data into a time domain representation to generate a decoded high frequency signal;

filtering at least one of the decoded low frequency signal and the decoded high frequency signal to reduce a distortion; and combining the decoded low frequency signal and the decoded high frequency signal to generate a decoded output signal.

21. The system of claim 20, wherein the audio decoder further comprises:

a highpass filter and a lowpass filter configured to have a combined spectral response that equals a flat frequency response.

22. The system of claim 21, wherein the highpass filter and the lowpass filter overlap for a portion of a frequency range.

23. The system of claim 20, wherein the audio decoder further comprises:

a delay element configured to delay the decoded low frequency signal.

24. The system of claim 23, wherein a delay duration associated with the delay element corresponds to a processing delay of the filter bank.

25. The system of claim 20, wherein the audio decoder further comprises:

an analysis filter bank configured to generate subband signals based on at least a portion of the decoded low frequency signal; and a canceller configured to zero-out the generated subband signals.

26. The system of claim 20, wherein the filter bank comprises a Quadrature Mirror Filter bank.

* * * * *